US009810173B2

(12) United States Patent
Hayman et al.

(10) Patent No.: US 9,810,173 B2
(45) Date of Patent: Nov. 7, 2017

(54) ENGINE ASSEMBLY

(71) Applicant: GM GLOBAL TECHNOLOGY OPERATIONS LLC, Detroit, MI (US)

(72) Inventors: Alan W. Hayman, Romeo, MI (US); Edward J. Keating, Ortonville, MI (US); Rodney E. Baker, Fenton, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 194 days.

(21) Appl. No.: 14/944,452

(22) Filed: Nov. 18, 2015

(65) Prior Publication Data

US 2017/0138295 A1 May 18, 2017

(51) Int. Cl.

| | |
|---|---|
| ***F02F 1/24*** | (2006.01) |
| ***F02M 35/10*** | (2006.01) |
| ***F02F 1/38*** | (2006.01) |
| ***F02F 1/40*** | (2006.01) |
| ***F02M 55/02*** | (2006.01) |

(52) U.S. Cl.

CPC ..... *F02F 1/242* (2013.01); *F02F 1/38* (2013.01); *F02F 1/40* (2013.01); *F02M 35/10177* (2013.01); *F02M 55/025* (2013.01)

(58) Field of Classification Search

CPC .... F02F 1/242; F02F 1/40; F02F 1/38; F02M 55/025; F02M 21/0278; F02M 21/0284; F02M 35/10177; F02M 37/0047; F02M 61/14; F02M 61/145

See application file for complete search history.

(56) References Cited

U.S. PATENT DOCUMENTS

2011/0247584 A1* 10/2011 Gentile ..... F02M 69/042 123/25 C
2014/0238340 A1* 8/2014 Dunn ..... F02M 43/00 123/299

* cited by examiner

*Primary Examiner* — Jacob Amick
(74) *Attorney, Agent, or Firm* — Quinn IP Law

(57) ABSTRACT

An engine assembly includes a cylinder head having an intake side and an exhaust side opposite the intake side. The cylinder head has an intake port, an exhaust port, and a combustion chamber in fluid communication with the intake port and the exhaust port. The engine assembly further includes a port fuel injector coupled to the cylinder head. The port fuel injector is disposed closer to the exhaust side than to the intake side of the cylinder head. Further, the port fuel injector is fluid communication with the intake port to allow fuel to be injected directly into the intake port. The engine assembly further includes a direct fuel injector coupled to the cylinder head. The direct injector is in fluid communication with the combustion chamber to allow fuel to be injected directly into the combustion chamber.

18 Claims, 2 Drawing Sheets

ENGINE ASSEMBLY

TECHNICAL FIELD

The present disclosure relates to an engine assembly including port fuel injectors and direct fuel injectors.

BACKGROUND

Some vehicles include internal combustion engines for propulsion. Internal combustion engines employ fuel to ignite an air-fuel mixture. This ignition causes a piston to move in a reciprocating manner. A crankshaft then converts the reciprocating motion into rotational motion in order to propel the vehicle.

SUMMARY

In an overhead valve (OHV) engine assembly, the pushrods of the valvetrain are disposed on opposite sides of each intake port. Accordingly, it is challenging to place both the direct fuel injectors and the port fuel injectors on the intake side of the cylinder head. However, incorporating direct fuel injectors and port fuel injectors into the engine assembly is desirable because it enhances the engine fuel economy. In addition to improving fuel economy, it is desirable to include direct fuel injectors and port fuel injectors capable of injecting fuel into the intake ports upstream of the intake valve in order to: (a) reduce dilution of the oil by fuel on cold starts; (b) improve particulate emissions performance; (c) reduce intake valve coking; (d) reduce tension in piston rings; (e) reduce oil sump fill volume due to improved oil quality; and (f) assist in extending the oil life. Accordingly, the presently disclosed engine assembly includes direct fuel injectors on the intake side of the cylinder head and port fuel injectors on the exhaust side of the cylinder head. By placing the direct fuel injectors on the intake side and the port fuel injectors on the exhaust side of the cylinder head, both the direct fuel injectors and the port fuel injectors can be incorporated into the engine assembly.

In certain embodiments, the engine assembly includes a cylinder head having an intake side and an exhaust side opposite the intake side. The cylinder head has at least one intake port, at least one exhaust port, and at least one combustion chamber. Each combustion chamber is in fluid communication with one intake port and one exhaust port. The engine assembly further includes at least one port fuel injector coupled to the cylinder head. The port fuel injector is disposed closer to the exhaust side than to the intake side of the cylinder head. Further, the port fuel injector is in fluid communication with the intake port to allow fuel to be injected directly into the intake port. The engine assembly further includes at least one direct fuel injector coupled to the cylinder head. The direct injector is in fluid communication with the combustion chamber to allow fuel to be injected directly into the combustion chamber. The present disclosure also describes vehicles including the engine assembly described above.

The above features and advantages and other features and advantages of the present teachings are readily apparent from the following detailed description of the best modes for carrying out the teachings when taken in connection with the accompanying drawings.

DETAILED DESCRIPTION

Figure 2:
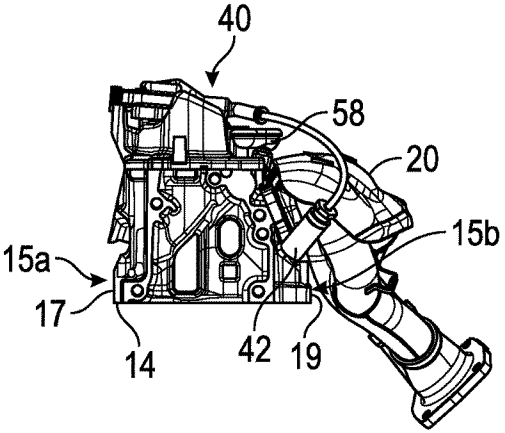
FIG. 2 is a schematic, front view of the engine assembly of FIG. 1.

Referring to the drawings, wherein like reference numbers correspond to like or similar components throughout the several figures, and beginning with FIGS. 1-7, a vehicle 10 includes an engine assembly 12 for propulsion. The vehicle 10 may be a truck, a car, a commercial vehicle, a military vehicle, an autonomous vehicle, farm equipment, construction equipment, or any other kind of vehicle capable of transporting passengers and/or objects. In the depicted embodiment, the engine assembly 12 includes an overhead valve (OHV) internal combustion engine 13. In other words, the engine assembly 12 has an OHV architecture. During operation of the engine assembly 12, the internal combustion engine 13 ignites an air-fuel mixture in order to propel the vehicle 10.

In the depicted embodiment, the internal combustion engine 13 includes a cylinder head 14 and an engine block 16 (FIG. 7) coupled to the cylinder head 14. In the depicted embodiment, the engine block 16 has a plurality of cylinders 29. The engine assembly 12 includes an intake manifold 18 coupled to the cylinder head 14 and an exhaust manifold 20 coupled to the cylinder head 14. The cylinder head 14 has at least one intake port 22 and at least one exhaust port 24. In the depicted embodiment, the cylinder head 14 includes a plurality of intake ports 22 and exhaust ports 24. The intake manifold 18 is in fluid communication with the intake ports 22. As such, intake air I can flow from the intake manifold 18 into the intake ports 22. The exhaust ports 24 are in fluid communication with the exhaust manifold 20. As such, exhaust gases E can flow from the exhaust ports 24 into the exhaust manifold 20 after combustion inside the engine assembly 12.

The cylinder head 14 has a first or intake side 15*a* and a second or exhaust side 15*b* opposite the intake side 15*a*. The intake side 15*a* of the cylinder head 14 is closer to the intake manifold 18 than to the exhaust manifold 20. The exhaust side 15*b* of the cylinder head 14 is closer to the exhaust manifold 20 than to the intake manifold 18. The cylinder head 14 has a first or intake lateral wall 17 and a second or exhaust lateral wall 19 opposite the first lateral wall 17. The first lateral wall 17 is on the intake side 15*a* of the cylinder head 14, and the second lateral wall 19 is on the exhaust side 15*b* of the cylinder head 14. Therefore, the first lateral wall 17 is closer to the intake manifold 18 than to the exhaust manifold 20, and the second lateral wall 19 is closer to the exhaust manifold 20 than to the intake manifold 18. In the depicted embodiment, the engine assembly 12 further includes a water jacket 21 for cooling. Water (or any other coolant) flows through the water jacket 21 to cool the engine assembly 12. The water jacket 21 may be coupled to or integrally formed with the cylinder head 14.

The cylinder head 14 defines a plurality of combustion chambers 26. Each combustion chamber 26 is in fluid communication with one intake port 22 and one exhaust port 24. Accordingly, intake air I can flow from the intake manifold 18 to the combustion chamber 26 via the intake ports 22, and exhaust gases E can flow from the combustion chamber 26 into the exhaust manifold 20 via the exhaust ports 24. The engine 13 further includes intake valves 28*a* for controlling the flow of intake air I into the combustion chamber 26 and includes exhaust valves 28*b* for controlling the flow of exhaust gases E into the exhaust manifold 20. Each intake valve 28*a* is at least partially disposed inside the intake port 22 and can move relative to the cylinder head 14 between an open position and a closed position. When the intake valve 28*a* is in the open position, intake air I can flow from the intake port 22 into the combustion chamber 26. In the closed position, the intake valve 28*a* prevents the intake air I from flowing from the intake port 22 into the combustion chamber 26. Each exhaust valve 28*b* is at least partially disposed inside the exhaust port 24 and can move relative to the cylinder head 14 between an open position and a closed position. When the exhaust valve 28*b* is in the open position, exhaust gases E can flow from the combustion chamber 26 into the exhaust port 24. In the closed position, the exhaust valve 28*b* prevents the exhaust gases E from flowing from the combustion chamber 26 into the exhaust port 24.

The engine assembly 12 includes a valvetrain 30 for controlling the operation of the intake valves 28*a* and the exhaust valves 28*b*. The valvetrain 30 includes a camshaft 32 disposed inside the engine block 16 and a plurality of pushrods 34 coupled to the camshaft 32. Pushrods 34 are located on opposite sides of each intake port 22. Each pushrod 34 is coupled to a rocker arm 36, and each rocker arm 36 is coupled to either one of the intake valves 28*a* or one of the exhaust valves 28*b*. Rotating the camshaft 32 causes the pushrods 34 to move up and down in the direction indicated by double arrows 4. Consequently, the rocker arm 36 pivots in order to move either the intake valve 28*a* or the exhaust valve 28*b* between the open and closed positions. The valvetrain 30 further includes springs 38 coupled between the cylinder head 14 and either the intake valves 28*a* or the exhaust valves 28*b* in order to bias the intake valves 28*a* or the exhaust valves 28*b* toward the closed position.

Figure 7:
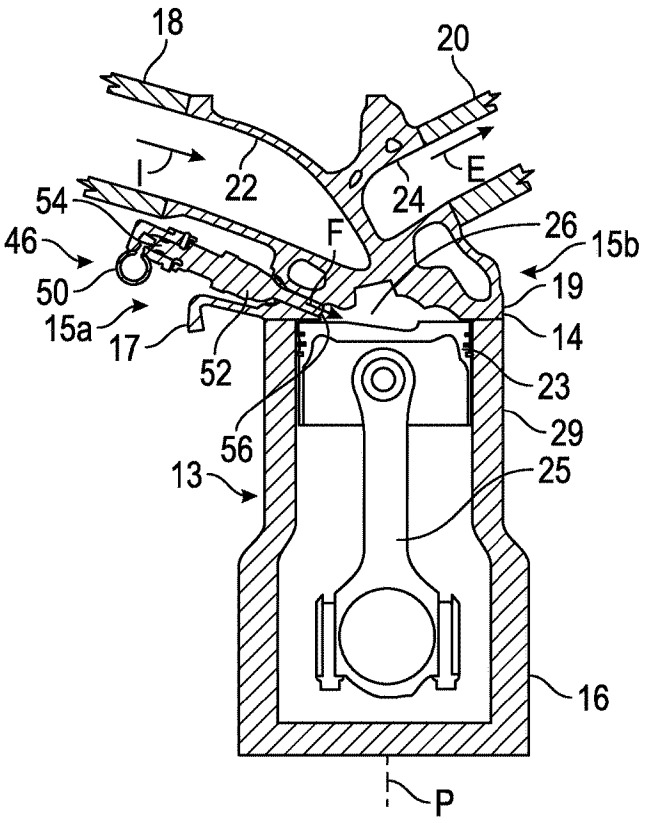
FIG. 7 is a schematic, cross-sectional view of the engine assembly of FIG. 1, showing an intake manifold, the cylinder head, an exhaust manifold, a piston, a direct fuel injection system, and an engine block.

With specific reference to FIG. 7, the internal combustion engine 13 further includes a plurality of pistons 23 inside the engine block 16. Each piston 23 is mechanically coupled to a connecting rod 25. The connecting rod 25 interconnects the piston 23 and a crankshaft, which converts the reciprocating motion of the piston 23 into a rotational motion. During operation of the internal combustion engine 13, each piston 23 moves in a reciprocating manner along a piston axis P through the cylinder 29.

The engine assembly 12 further includes an ignition system 40 for igniting an air-fuel mixture in the combustion chamber 26. The ignition system 40 includes a plurality of spark plugs 42 configured to deliver electric current to the combustion chamber 26 of the engine assembly 12. During operation of the engine assembly 12, the electric current delivered by the spark plugs 42 ignites the air-fuel mixture in the combustion chamber 26.

The engine assembly 12 further includes a fuel delivery arrangement 44 for delivering fuel, such as gasoline, into the combustion chamber 26. The fuel delivery arrangement 44 includes a direct injection (DI) system 46 and a port fuel injection (PFI) system 48. The DI system 46 can deliver fuel, such as gasoline, directly into the combustion chamber 26 and includes a DI fuel rail 50 and a plurality of direct fuel injectors 52. Each direct fuel injector 52 is in fluid communication with the DI fuel rail 50, thereby allowing fuel F to flow from the DI fuel rail 50 to each direct fuel injector 52. All the direct fuel injectors 52 are coupled to the cylinder head 14. As such, each direct fuel injector 52 can deliver fuel F directly into the combustion chambers 26. The direct fuel injectors 52 are coupled on the intake side 15*a* of the cylinder head 14. Accordingly, the direct fuel injectors 52 are closer to the intake manifold 18 and the first lateral wall 17 than to the exhaust manifold 20 and the second lateral wall 19, respectively. Each direct fuel injector 52 extends through the cylinder head 14 and is obliquely angled relative to the piston axis P due to the packaging constraints of the engine assembly 12. In the depicted embodiment, each direct fuel injector 52 has a first direct injector end 54 and a second direct injector end 56 opposite the first direct injector end 54. The first direct injector end 54 is directly coupled to the DI fuel rail 50, whereas a second direct injector end 56 is disposed within (or adjacent to) the combustion chamber 26 in order to allow the direct fuel injector 52 to inject fuel F directly into the combustion chamber 26. Due to packaging constraints in the engine assembly 12, the DI fuel rail 50 is closer to the intake side 15*a* than to the exhaust side 15*b* of the cylinder head 14.

The PFI system 48 can deliver fuel F, such as gasoline, directly into the intake ports 22 upstream of the intake valves 28*a* and includes a PFI fuel rail 58 and a plurality of port fuel injectors 60. Each port fuel injector 60 is in fluid communication with the PFI fuel rail 58, thereby allowing fuel F to flow from the PFI fuel rail 58 to each port fuel injectors 60. All the port fuel injectors 60 are coupled to the cylinder head 14. As such, each port fuel injector 60 can deliver fuel F directly into the intake ports 22. Due to packaging constraints in the engine assembly 12, the port fuel injectors 60 are coupled on the exhaust side 15*b* of the cylinder head 14. Specifically, because the pushrods 34 are disposed on opposite sides of each intake port 22, the pushrods 34 impede placing both the direct fuel injectors 52 and the port fuel injectors 60 on the intake side 15*a* of the cylinder head 14. However, incorporating direct fuel injectors 52 and port fuel injectors 60 into the engine assembly 12 is desirable because it enhances the engine fuel economy. In addition to improving fuel economy, it is desirable to include direct fuel injectors 52 and port fuel injectors 60 capable of injecting fuel into the intake ports 22 upstream of the intake valve 28*a* in order to: (a) reduce dilution of the oil by fuel on cold starts; (b) improve particulate emissions performance; (c) reduce intake valve coking; (d) reduce tension in piston rings; (e) reduce oil sump fill volume due to improved oil quality; and (f) assist in extending the oil life. Accordingly, the presently disclosed engine assembly 12 includes direct fuel injectors 52 on the intake side 15*a* of the cylinder head 14 and port fuel injectors 60 on the exhaust side of the cylinder head 14. By placing the direct fuel injectors 52 on the intake side 15*a* and the port fuel injectors 60 on the exhaust side 15*b* of the cylinder head 14, both the direct fuel injectors 52 and the port fuel injectors 60 can be incorporated into the engine assembly 12.

Figure 4:
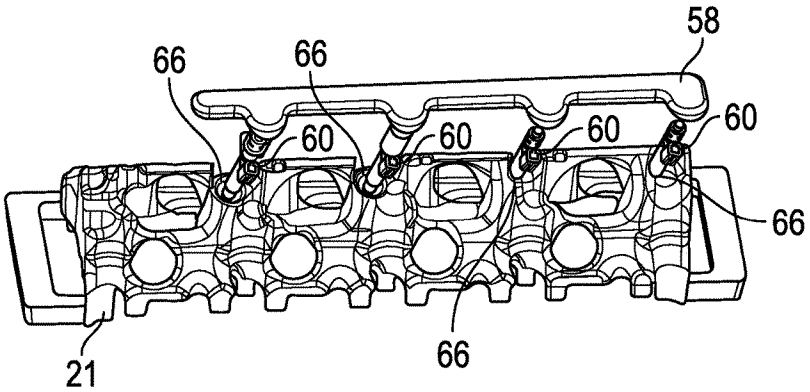
FIG. 4 is a schematic, perspective view of a port fuel injection system and a water jacket of the engine assembly of FIG. 1.
Figure 1:
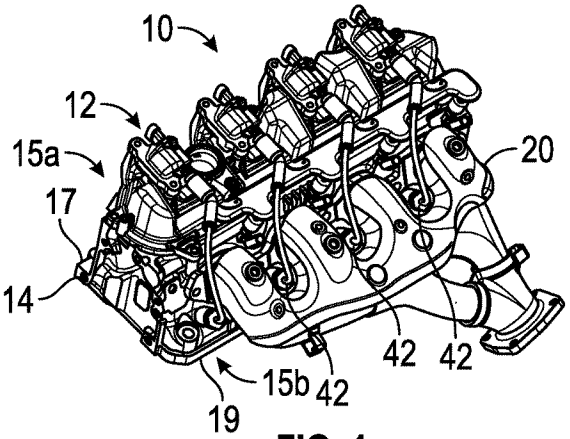
FIG. 1 is a schematic, perspective view of an overhead valve (OHV) engine assembly of a vehicle in accordance with an embodiment of the present disclosure.
Figure 3:
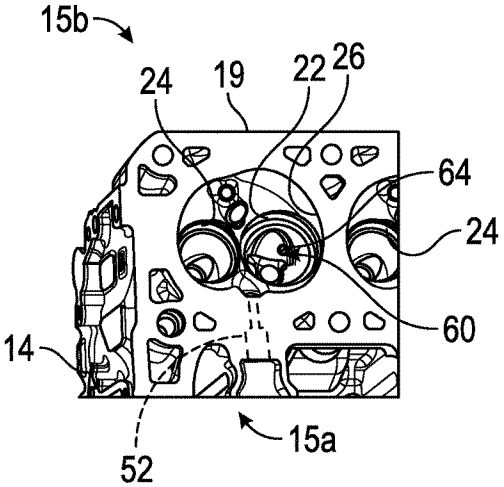
FIG. 3 is a schematic, bottom, fragmentary view of the engine assembly of FIG. 1.
Figure 5:
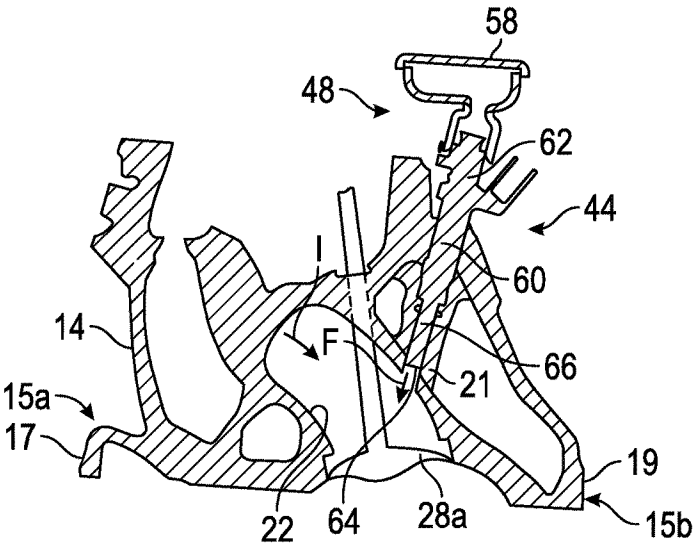
FIG. 5 is a schematic, cross-sectional, fragmentary view of the engine assembly of FIG. 1, showing the cylinder head, the intake port, the intake valve, and the port fuel injection system.
Figure 6:
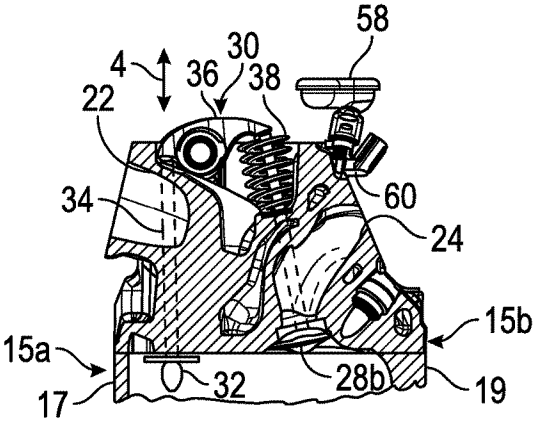
FIG. 6 is a schematic, cross-sectional, fragmentary view of the engine assembly of FIG. 1, showing the cylinder head and a valvetrain.

In particular, the port fuel injectors 60 are closer to the exhaust manifold 20 and the second lateral wall 19 than to the intake manifold 18 and the first lateral wall 17, respectively. Each port fuel injector 60 extends through the cylinder head 14 and is obliquely angled relative to the piston axis P due to the packaging constraints of the engine assembly 12. In the depicted embodiment, each port fuel injector 60 has a first port fuel injector end 62 and a second port fuel injector end 64 opposite the first port fuel injector end 62. The first port fuel injector end 62 is directly coupled to the PFI fuel rail 58, whereas the second port fuel injector end 64 is disposed within (or adjacent to) the intake port 22 in order to allow the port fuel injector 60 to inject fuel F directly into intake port 22 upstream of the intake valve 28*a*. Due to packaging constraints in the engine assembly 12, the PFI fuel rail 58 is closer to the exhaust side 15*b* of the cylinder head 14 than to the intake side 15*a* of the cylinder head 14. As shown in FIGS. 4 and 5, the water jacket 21 defines a plurality of injector receiving openings 66. Each injector receiving opening 66 is configured, shaped, and sized to receive one of the port fuel injector 60 in order to cool the port fuel injectors 60.

While the best modes for carrying out the teachings have been described in detail, those familiar with the art to which this disclosure relates will recognize various alternative designs and embodiments for practicing the teachings within the scope of the appended claims.

The invention claimed is:

1. An engine assembly, comprising:

a cylinder head having an intake side and an exhaust side opposite the intake side, wherein the cylinder head defines an intake port, an exhaust port, and a combustion chamber in fluid communication with the intake port and the exhaust port;

a port fuel injector coupled to the cylinder head, wherein the port fuel injector is disposed closer to the exhaust side than to the intake side of the cylinder head, and the port fuel injector is in fluid communication with the intake port to allow fuel to be injected directly into the intake port; and a direct fuel injector coupled to the cylinder head, wherein the direct fuel injector is in fluid communication with the combustion chamber to allow fuel to be injected directly into the combustion chamber.

2. The engine assembly of claim 1, wherein the cylinder head includes a water jacket, the water jacket defines an injector receiving opening, and the port fuel injector extends through the injector receiving opening.

3. The engine assembly of claim 1, wherein the direct fuel injector is closer to the intake side than to the exhaust side of the cylinder head.

4. The engine assembly of claim 1, wherein the engine assembly has an overhead valve architecture.

5. The engine assembly of claim 1, further comprising an intake valve movably disposed in the intake port, wherein the port fuel injector has a first port fuel injector end and a second port fuel injector end opposite the first port fuel injector end, and the second port fuel injector end is adjacent the intake port such that the port fuel injector is configured to inject fuel directly into the intake port upstream of the intake valve.

6. The engine assembly of claim 1, further comprising a port fuel injection (PFI) fuel rail in fluid communication with the port fuel injector, wherein the PFI fuel rail is closer to the exhaust side than to the intake side of the cylinder head.

7. The engine assembly of claim 1, further comprising a direct injection (DI) fuel rail in fluid communication with the direct fuel injector, wherein the DI fuel rail is closer to the intake side than to the exhaust side of the cylinder head.

8. The engine assembly of claim 1, further comprising an intake manifold in fluid communication with the intake port and an exhaust manifold in fluid communication with the exhaust port, wherein the direct fuel injector is closer to the intake manifold than to the exhaust manifold.

9. The engine assembly of claim 8, wherein the port fuel injector is closer to the exhaust manifold than to the intake manifold.

10. A vehicle, comprising:

a cylinder head having an intake side and an exhaust side opposite the intake side, wherein the cylinder head defines a plurality of intake ports, a plurality of exhaust ports, and a plurality of combustion chambers, and wherein each combustion chamber is in fluid communication with one of the intake ports and one of the exhaust ports;

an engine block coupled to the cylinder head;

a plurality of port fuel injectors each coupled to the cylinder head, wherein each port fuel injector is disposed closer to the exhaust side than to the intake side of the cylinder head, and each port fuel injector is in fluid communication with one of the intake ports to allow fuel to be injected directly into said one of the intake ports; and a plurality of direct fuel injectors each coupled to the cylinder head, wherein each direct injector is in fluid communication with one of the combustion chambers to allow fuel to be injected directly into said one of the combustion chambers.

11. The vehicle of claim 10, wherein the cylinder head includes a water jacket, the water jacket defines a plurality of injector receiving openings, each of the port fuel injectors extends through one of the injector receiving openings.

12. The vehicle of claim 10, wherein each of the direct fuel injectors is closer to the intake side than to the exhaust side of the cylinder head.

13. The vehicle of claim 10, wherein the cylinder head, the engine block, the port fuel injectors, and the direct fuel injectors are part of an engine assembly, and the engine assembly has an overhead valve architecture.

14. The vehicle of claim 10, further comprising an intake valve movably disposed in the intake port, wherein the port fuel injector has a first port fuel injector end and a second port fuel injector end opposite the first port fuel injector end, and the second port fuel injector end is adjacent the intake port such that the port fuel injector is configured to inject fuel directly into the intake port upstream of the intake valve.

15. The vehicle of claim 10, further comprising a port fuel injection (PFI) fuel rail in fluid communication with the port fuel injectors, wherein the PFI fuel rail is closer to the exhaust side than to the intake side of the cylinder head.

16. The vehicle of claim 10, further comprising a direct injection (DI) fuel rail in fluid communication with the direct fuel injectors, wherein the DI fuel rail is closer to the intake side than to the exhaust side of the cylinder head.

17. The vehicle of claim 10, further comprising an intake manifold in fluid communication with the intake ports and an exhaust manifold in fluid communication with the exhaust ports, wherein each of the direct fuel injectors is closer to the intake manifold than to the exhaust manifold.

18. The vehicle of claim 17, wherein each of the port fuel injectors is closer to the exhaust manifold than to the intake manifold.

* * * * *